US005149611A

United States Patent [19]

Kohri et al.

[11] Patent Number: 5,149,611

[45] Date of Patent: Sep. 22, 1992

[54] COLOR TONER FOR DEVELOPING ELECTROSTATIC LATENT IMAGE

[75] Inventors: Toshitaro Kohri; Junji Machida; Masahiro Anno, all of Osaka, Japan

[73] Assignee: Minolta Camera Kabushiki Kaisha, Osaka, Japan

[21] Appl. No.: 566,890

[22] Filed: Aug. 13, 1990

Related U.S. Application Data

[63] Continuation of Ser. No. 265,672, filed as PCT/JP88/00152, Feb. 16, 1988, abandoned.

[30] Foreign Application Priority Data

Feb. 17, 1987 [JP] Japan ..... 62-35189
Jan. 12, 1988 [JP] Japan ..... 63-5341

[51] Int. Cl.[5] ..... G03G 9/09; G03G 9/097

[52] U.S. Cl. ..... 430/110; 430/106; 430/137

[58] Field of Search ..... 430/110, 137

[56] References Cited

U.S. PATENT DOCUMENTS

| | | | |
|---|---|---|---|
| 3,196,032 | 7/1965 | Seymour | 430/137 |
| 3,431,412 | 3/1969 | Okubo | 430/110 X |
| 3,655,374 | 4/1972 | Palermiti | 430/121 |
| 3,817,868 | 6/1974 | van Besauw | 430/110 |
| 4,137,188 | 1/1979 | Uetake et al. | 430/903 X |
| 4,314,017 | 2/1982 | Takahashi et al. | 430/110 X |
| 4,839,255 | 6/1989 | Hyosu et al. | 430/137 |
| 4,859,560 | 8/1989 | Nakamura et al. | 430/137 |

FOREIGN PATENT DOCUMENTS

| | | |
|---|---|---|
| 57-64249 | 4/1982 | Japan . |
| 57-125943 | 8/1982 | Japan . |
| 59-174857 | 10/1984 | Japan . |
| 62-212852 | 9/1986 | Japan . |
| 62-8169 | 1/1987 | Japan . |
| 62-129866 | 6/1987 | Japan . |
| 62-159155 | 7/1987 | Japan . |

*Primary Examiner*—Roland Martin
*Attorney, Agent, or Firm*—Burns, Doane, Swecker & Mathis

[57] ABSTRACT

The present invention relates to a color toner, to the surface of which a small amount of charge-giving agent is fixed. The amount of the charge-giving agent is usually 0.03% to 0.65% by weight of toner, and it becomes still smaller when the resin composing the toner is made from a monomer including a nitrogen containing polar functional group or fluorine containing polar functional group. This composition enables the toner to be charged stably in a narrow charge distribution, thereby decreasing the fog and flying of toner, and resulting in a distinct color image without any turbidity in color.

19 Claims, 4 Drawing Sheets a: direction of rotation of magnet roll
b: direction of migration of developer

COLOR TONER FOR DEVELOPING ELECTROSTATIC LATENT IMAGE

This application is a continuation of application Ser. No. 07/265,672, filed as PCT/JP88/00152, Feb. 16, 1988, now abandoned.

FIELD OF THE INVENTION

The present invention relates to a color toner for developing an electrostatic latent image.

BACKGROUND OF THE INVENTION

In the development of an electrostatic latent image, the electrostatic latent image formed on a photosensitive member electrostatically adsorbs a frictionally charged toner.

As the conventional method for giving a toner electric charges, the developing method of two-component system is publicly known, in which a toner is mixed with a carrier, and stirred therewith, thereby being electrically charged . In one-component system, a toner is rubbed with a developing sleeve, a toner controlling blade, or a photosensitive member, thereby being electrically charged. In either of these methods, if the toner is not electrified evenly, there cause disadvantages in the developing and transferring steps. For this reason, in the conventional method for charging a toner with static electricity, the toner is incorporated with a charge-giving agent for giving the toner charges opposite to those of the carrier or the blade member. For example, a toner obtained by the pulverizing method is produced by mixing a charge-giving agent with a thermoplastic resin and a colorant, and kneading, pulverizing the obtained mixture, followed by classifying the obtained particles. In the suspension polymerized toner, a colorant and a charge-giving agent are dispersed into monomers, and they are polymerized to obtain a toner. In the capsule toner, a charge-giving agent is mixed with a colorant, and a substance of a low softening point such as a wax or the like, or with a liquid containing a fixing resin, and the obtained mixture is enveloped with a layer (serving as a capsul) of a higher softening point than that of each component of the above mixture. Furthermore, the Laid-Open Japanese Patent Publication No. 210368/1986 discloses a method in which the spherical resin particles of a negligibly small diameter, a binding resin, and a colorant are mixed and stirred at a temperature lower than the softening point of the spherical particle of the resin, and higher than the softening point of the binding resin, so that the colorant is adhered to the spherical particle of the resin by the aid of the fused binding resin. Still furthermore, the Laid-Open Japanese Patent Publication No. 37553/1984 discloses another method in which a colorant is adhered to the particle surface of a resin.

It is to be noted that in any of pulverized toner, suspension polymerized toner, capsul toner and the like, the charge-giving agent is present inside the obtained toner particle, however few is present on the surface of the particle. For this reason, the charge distribution of the toner becomes large resulting in problems of flying and fog of the toner. Furthermore, in the pulverized toner or capsul toner, whether or not each component of toner is dispersed homogeneously affects the variability of the charge distribution over the toner. Therefore, it becomes an important subject to homogeneously disperse each of components of toner.

Though the Laid-Open Japanese Patent Publication No. 210368/1986 discloses a toner, this toner also has the above-mentioned problems, because the surface of the toner particle is coated with a binding resin of a low softening point. Furthermore, in the toner disclosed in the Laid-Open Japanese Patent Publication No. 37553/1984, a colorant is adhered only to the surface of the toner particle, so that the image density or ID becomes low due to the shortage of colorant; however, the addition of a large amount of colorant causes the flake of colorant from the toner particle, and the flaked colorant is adhered to the surface of carrier, or is mixed with the developer, resulting in deterioration in copying resistance.

Especially, when a color toner is produced according to the conventional pulverizing method or spray-drying method, the colored charge-giving agent conventionally used for a black toner is required to be added in a certain large amount so as to give sufficient charges to the toner, which causes turbidity in color, resulting in an unsatisfactory color image.

The recent attention is paid to a colorless or light-colored charge-giving agent for a color toner such as phenothiazine compound as is disclosed in the Laid-Open Japanese Patent Publication No. 20485/1984; however, this agent has a problem of unstability in environment resistance, build-up time of electrification, or electrifying properties during copying operation, therefor not meeting the requirements of a toner.

Furthermore, a color toner containing, as a functional group of a resin, a polar group such as an amino group useful for improving charge-giving properties is proposed, for example, in the Laid-Open Japanese Patent Publication No. 3648-1985; however, it has also a problem of unstability in environment resistance, electrification-build-up time, and electrifying properties during copying operation, therefor not meeting the requirements of a toner.

The object of the present invention is to provide a stable color toner for developing an electrostatic latent image, which hardly flies about or spills on a copying sheet, and is superior in long-period electrification stability, environment resistance, and further quick in electrification build-up time, thereby overcoming the aforementioned problems. Another object of the present invention is to provide a color toner capable of reproducing a clear color image without any turbidity.

DISCLOSURE OF THE INVENTION

The present invention relates to a color toner for developing an electrostatic latent image containing at least a thermoplastic resin, a colorant, and a charge-giving agent, characterized by comprising at least a core material containing the thermoplastic resin and the colorant; and the charge-giving agent adhered to the surface of the core material at the content of 0.03 to 0.65% by weight. Furthermore, the present invention relates to a color toner for developing an electrostatic latent image containing at least a thermoplastic resin, a colorant and a charge-giving agent, characterized by comprising a core material containing a resin as the thermoplastic resin composed of at least a nitrogen containing polar functional group or a fluorine containing polar functional group, and the colorant; and the charge-giving agent adhered to the surface of the core material at the content of 0.03 to 0.65% by weight.

The color toner according to the present invention comprises at least a core material containing a thermoplastic resin and a colorant; and a charge-giving agent adhered to the surface of the core material.

The color toner according to the present invention is obtained by electrically adhering a negative or positive charge-giving agent to the surface of the above-mentioned core material, and then, partially heating the surface of the core material to fix the charge-giving agent on the surface of core material.

A thermoplastic resin employed in the present invention is not particularly limited, but may be a resin generally used for a toner; for example, the thermoplastic resin can be prepared from one or more than two of the following monomers, i.e. monofunctional monomers such as vinyl monomer, acrylic monomer, methacrylic monomer or the like; or polyfunctional monomer. Otherwise, as the thermoplastic resin, is employed polyamide, polyester, epoxy, polyether, polycarbonate, polyacid anhydride, and polyurethane; and polyolefine such as polyethylene, polypropylene or the like.

A monofunctional monomer is exemplified by styrene monomers such as styrene, α-methylstyrene, o-methylstyrene, mmethylstyrene, p-methylstyrene, p-ethylstyrene, 2,4-dimethylstyrene, p-n-butylstyrene, p-tert-butylstyrene, p-n-hexylstyrene, p-n-octylstyrene, p-n-nonylstyrene, p-n-decylstyrene, p-n-dodecylstyrene, p-methoxystyrene, and p-phenyl styrene: acrylic monomers such as methylacrylate, ethylacrylate, n-propylacrylate, iso-propylacrylate, n-butylacrylate, isobutylacrylate, tert-butylacrylate, n-amylacrylate, n-hexylacrylate, 2-ethylhexylacrylate, n-octylacrylate, n-nonylacrylate, cyclohexylacrylate, benzylacrylate, dimethylphosphate ethylacrylate, diethyl phosphate ethyl acrylate, dibutyl phosphate ethyl acrylate, and 2-benzoyl oxy ethyl acrylate: methacrylate monomers such as methylmethacrylate, ethylmethacrylate, n-propylmethacrylate, iso-propylmethacrylate, n-butylmethacrylate, iso-butylmethacrylate, tert-butylmethacrylate, n-amylmethacrylate, n-hexylmethacrylate, 2-ethylhexylmethacrylate, n-octylmethacrylate, n-nonylmethacrylate, diethyl phosphate ethyl methacrylate, and dibutyl phosphate ethyl methacrylate: methylene aliphatic monocarboxylic acid esters: and vinyl esters such as vinyl acetate, vinyl propionate, vinyl benzoate, vinyl butyrate, vinyl formate or the like; vinyl ethers such as vinyl methyl ether, vinyl ethyl ether, vinyl isobutyl ether or the like; and vinyl ketones such as vinyl methyl ketone, vinyl hexyl ketone, methyl isopropyl ketone or the like. Polyfunctional monomer is diethylene glycol diacrylate, triethylene glycol diacrylate, tetraethylene glycol diacrylate, polyethylene glycol diacrylate, 1,6-hexanediol diacrylate, neopentyl glycol diacrylate, tripropyrene glycol diacrylate, polypropyrene glycol diacrylate, 2,2-bis[4-(acryloxy.diethoxy)phehyl]propane, trimethylolpropane triacrylate, tetramethylolmethane tetracrylate, ethylene glycol dimethacrylate, diethylene glycol dimethacrylate, triethylene glycol dimethacrylate, tetraethylene glycol dimethacrylate, polyethylene glycol dimethacrylate, 1,3-butylene glycol dimethacrylate, 1,6-hexanediol dimethacrylate, neopentyl glycol dimethacrylate, polypropylene glycol dimethacrylate, 2,2'-bis[4-(methacryloxy.diethoxy)phenyl]propane, 2,2'-bis[4-(methacryloxy.polyethoxy)phenyl]propane, trimethylol propane trimethacrylate, tetramethylolmethane trimethacrylate, divinylbenzene, divinylnapthalene, divinylether or the like.

The thermoplastic resin can be prepared from only the above-mentioned monofunctional monomers, or more than 2 kinds thereof, and it also can be prepared by the combination of monofunctional monomers and polyfunctional monomers.

Further, the thermoplastic resin can be prepared by the copolymerization of the monofunctional monomer or polyfunctional monomer with a monomer component having a nitrogen containing polar functional group or fluorine.

Furthermore, the thermoplastic resin may be a blended mixture comprising a polymer of the monofunctional monomers or polyfunctional monomers, and a polymer of a monomer having a nitrogen containing polar functional group or a monomer containing fluorine.

As mentioned above when the core material of the toner is composed of the thermoplastic resin containing a polar group, a small amount of charge-giving agent to be adhered to the surface of the core material is sufficient to achieve the object of the present invention, because the resin itself can serve as an electrifying control.

The nitrogen containing polar functional group is useful for controlling positive charges, and the monomer containing the same is expressed by the following formula [1]:

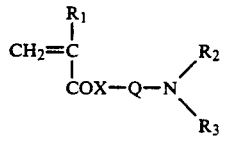

(1)

[in which $R_1$ is hydrogen or a methyl group, $R_2$ and $R_3$ are hydrogen or an alkyl group having 1 to 20 carbon atoms, X is oxygen or nitrogen, and Q is an alkylene group or an allylene group.]

A typical example of amino(metha)acrylic monomers is N,N-dimethyl aminomethyl(metha)acrylate, N,N-diethylamino methyl(metha)acrylate, N,N-diethylaminomethyl(metha)acrylate, N,N-dimethylaminoethyl(metha)acrylate, N,N-diethyl aminoethyl(metha)acrylate, N,N-dimethylaminopropyl(metha) acrylate, N,N-dimethylaminobutyl(metha)acrylate, p-N,N-dimethyl aminophenyl(metha)acrylate, p-N,N-diethylaminophenyl(metha) acrylate, p-N,N-dipropylaminophenyl(metha)acrylate, p-N,N-dibutylaminophenyl(metha) acrylate, p-N-laurylaminophenyl (metha)acrylate, p-N-stearylaminophenyl(metha)acrylate, p-N,N-dimethyl aminobenzyl(metha) acrylate, p-N,N-diethyl aminobenzyl(metha)acrylate, p-N,N-dipropylaminobenzyl(metha) acrylate, p-N,N-dibutylaminobenzyl(metha)acrylate, p-N-lauryl aminobenzyl(metha)acrylate, p-N-stearylaminobenzyl(metha) acrylate or the like. Another example of amino(metha)acrylic monomer is N,N-dimethylaminoethyl(metha)acrylamide, N,N-diethyl aminoethyl(metha)acrylamide, N,N-dimethylaminopropyl(metha) acrylamide, N,N-diethylaminopropyl(metha)acrylamide, p-N,N-dimethylaminophenyl(metha)acrylamide, p-N,N-diethylaminophenyl (metha)acrylate, p-N,N-dipropylaminophenyl(metha)acrylamide, p-N,N-dibutylaminophenyl(metha)acrylamide, p-N-laurylaminophenyl (metha)acrylamide, p-N-stearylaminophenyl(metha)acrylamide, p-N,N-dimethylaminobenzyl(metha)acrylamide, p-N,N-diethyl aminobenzyl(metha)acrylamide, p-N,N-dipropylaminobenzyl (metha)acrylamide, p-N,N-dibutylaminobenzyl(metha)acrylamide, p-N-laurylaminobenzyl(metha)acrylamide, p-N-stearylaminobenzyl (metha)acrylamide or the like.

Fluorine is useful for controlling negative charges, and the limitation is not particularly given to fluorine containing monomer, however the preference is given to fluoro alkyl acrylate or methacrylate, and such fluoro alkyl acrylate is 2,2,2-trifluoroethyl acrylate, 2,2,3,3-tetrafluoropropyl acrylate, 2,2,3,3,4,4,5,5-octafluoroamyl acrylate, 1H,1H,2H,2H-heptadeca fluorodecyl acrylate or the like. Otherwise, trifluoro chloroethylene, vinylidene fluoride, 3-fluoroethylene, 4-fluoroethylene, trifluoropropyrene, hexafluoropropene, hexafluoro propyrene or the like may be available.

A colorant employed in the present invention is as follows:

for a yellow pigment, is available chrome yellow, zinc yellow, cadmium yellow, yellow oxide, mineral fast yellow, nickel titanium yellow, nables yellow, naphthol yellow S, hansa yellow G, hansa yellow 10G, benzidine yellow G, benzidine yellow GR, quinoline yellow lake, permanent yellow, NCG, tartrazine lake or the like;

for an orange pigment, is available chrome orange, molybdenum orange, permanent orange GTR, pyrazolone orange, vulcan orange, indanthrene brilliant orange RK, benzidine orange G, indanthrene brilliant orange GK or the like;

for a red pigment, is available red iron oxide, cadmium red, red lead oxide, cadmium mercury sulfide, permanent red 4R, lithol red, pyrazolone red, watchung red, calcium salt, lake red D, brilliant carmine 6B, eosine lake, rhodamine lake B, alizarin lake, brilliant carmine 3B or the like;

for a purple pigment, is available manganese violet, fast violet B, methyl biolet lake or the like;

for a blue pigment, is available prussian blue, cobalt blue, alkali blue lake, victoria blue lake, phthalocyanine blue, metal-free phthalocyanine blue, phthalocyanine blue partial chlorine compound, fast sky blue, indanthrene blue BC or the like; for a green pigment, is available chrome green, chrome oxide green, pigment green B, malachite green lake, fanal yellow green G or the like; and for a white pigment, is available zinc white, titanium oxide, antimony white, zinc sulfide or the like.

If necessary, carbon black such as furnace combustion black, channel black, or acetylene black, alternately, activated carbon, unmagnetic ferrite or the like may be used as a black pigment in combination with other colorants.

For an extender pigment, is available powdery barytes, barium carbonate, clay, silica, white carbon, talc, alumina white or the like, and in use, one or more than two of them can be mixed. In any case, the limitation is not particularly given to the extender pigment, and other organic or inorganic pigments can be available, if they are pollution-free, and have high coloring power.

For the charge-giving agent employed in the present invention, any organic or inorganic substance which can give the toner positive or negative charges after the frictional electrification with the core material may be available. As an example of a positive charge-giving agent, is available nigrosine dyes; quarternary ammonium compound expressed as the bellow formula [II]:

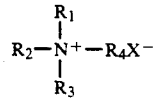

(II)

[in which $R_1$, $R_2$, $R_3$, and $R_4$ is the same or different alkyl group, aryl group, or two of any of the above groups may form a group of a heterocyclic ring; X is halogen, a sulfonic group, a sulfonic ester group, a sulfate ester group or an alkyl sulfide ester group]; a charge-giving agent as stated in the Laid-Open Japanese Patent Publication Nos. 78364/1984, 136746/1984, 114546/1984, and 123850/1984; and copolymerizate such as amino acrylate or the like (for example, a copolymer of styrene and diethyl aminoethyl methacrylate).

As a positive charge-giving agent, nigrosine dye is preferably available. Commercially available nigrosine dye is Bontron N-01, N-02, N-04, N-05, N-07, N-09, N-10, N-13, or the like (produced by Orient Kagaku Kogyo K.K.). As a negative charge-giving agent, are available a dye having a metal-chelated structure of Cr, Co, Fe, Al, etc.; and Kayacharge N-1, N-2, N-3 (produced by Nippon Kayaku K.K.).

The afore-mentioned dye having the metal-chelated structure is Bontron S-32, S-33, S-34, S-35, S-37, S-38, S-40, S-44, E-81, E-82, E-84,E-85 (produced by Orient Kagaku Kogyo K.K.), Aizen Spilon Black TRH, BHH (Hodogaya Kagaku Kogyo K.K.) Kayaset Black T-2, 004 (produced by Nippon Kayaku K.K.), or the dyes disclosed in the Laid-Open Japanese Patent Publication Nos. 78361/1984, 88744/1984, 228259/1984.

As the core material for the toner employed in the present invention, any material as known in the prior arts may be available. Namely, any material to which the charge-giving agent can be adhered, and which can retain charges evenly may be available. Such a core material can be used for a pulverized toner obtained by mixing and kneading a thermoplastic resin, a colorant, and/or a charge-giving agent, etc., pulverizing the kneaded mixture, and classfying the obtained particles; a spherical toner obtained by suspension polymerization; and a capsul toner in which the core material is covered by a shell.

The particle diameter of the core material employed in the present invention is within a range of 4 to 20 μm. The particle diameter of the charge-giving agent is within a range of 0.02 to 10 μm for practical usage, and more preferably within a range of 0.1 to 3 μm. Generally, the charge giving agent of a large diameter is formed by the cohesion of small particles with an effective primary particle size of less than 1 μm. Even when employing a charge-giving agent of a large particle diameter, the charge-giving agent is crushed into small particles by mechanical pressure in course of electrostatically adhering the charge-giving agent to the core material, so that the charge-giving agent of a small particle size can be adhered to the surface of the core material. The amount of charge-giving agent to be adhered to the surface of the core material is finally determined by its amount exposed over the surface of the color toner according to a measuring method as will e described later in this invention.

The amount of charge-giving agent to be adhered to the surface of the core material is 0.03 to 0.65% by weight, more preferably 0.1 to 0.5% by weight of the toner, when the thermoplastic resin composing the core material does not contain a nitrogen containing polar functional group or fluorine. If it is less than 0.03% by weight, the electrification bulid-up time becomes slow, so that the charge amount becomes insufficient. If it is more than 0.65% by weight, turbidity in a color image (especially yellow) occurs, resulting in an indistinct image.

When the thermoplastic resin composing the core material contains a nitrogen containing polar functional group or fluorine, the amount of charge-giving agent to be adhered to the surface of the core material is 0.005 to 0.65% by weight, more preferably 0.05 to 0.5% by weight of the toner, though it depends on the content of the functional group. It is to be noted that this case requires smaller amount of charge-giving agent than the case where the thermoplastic resin does not serve as a charge-giving substance. If its amount is less than 0.005% by weight, the electrification build-up time becomes slow, so that the charge amount becomes insufficient. If it is more than 0.65% by weight, turbidity occurs in a color image.

As a method for adhering a positive or negative charge-giving agent to the core material of the color toner, the core material and charge-giving agent are charged into a tank having rotating blades such as the conventional henschel mixer and super mixer, and are rotated therein, thereby being rubbed with each other to cause frictional electrification, so that the charge-giving agent is adhered to the surface of the core material. However, the charge-giving agent may be adhered to the surface of the core material in any other method in place of this method.

As a method for partially heating the surface of toner adhere by a charge-giving agent, core materials with the charge-giving agent are charged into an agitator such as the instantaneous heating apparatus as stated in the Laid-Open Japanese Patent Publication No. 117258/1985, the hybridization system (manufactured by Nara Kikai Seisakusho K.K.), the henschel mixer, the ang mill (manufactured by Hosokawa Micron K.K.), etc., and they are agitated to cause heating on its surface; or it is subjected to microwaves to cause heating on its surface. Anyway, any method, apparatus, means can be available, if it can partially heat the surface of toner adhered by a charge-giving.

Furthermore, the surface of the core material coated with the charge-giving agent may be partially fused or swollen with a small amount of organic solvent by means of the SPIR-A-FLOW (manufactured by Furointo Sangyo K.K.), etc., whereby the charge-giving agent may be fixed to the surface of the toner.

PREFERRED EMBODIMENTS

The present invention will be described more in detail, taken in conjunction with preferred embodiments.

SYNTHESIS OF A THERMOPLASTIC RESIN

Four hundred and ninety four g of styrene (St), 39.3 g of dimethylaminoethylmethacrylate (DMAM), 270 g of toluene, and 2.7 g of azobisisobutyronitrile (AIBN) were mixed in a four-necked flask of a capacity of 1 l, fused, and reacted at 80° C. under a nitrogen stream for 6 hours for polymerization. Then, toluene was distilled away, the remainder was reduced to 40 to 50 mmHg at 180° C. to 190° C., and thereafter, the entire volatile content was removed. The resultant polymer was a crystal-clear solid, having a glass transition point (Tg) of 81° C., and an amine value of 25.

Thermoplastic resins (references 1 to 7) as shown in the below Table 1 were prepared in the same manner.

TABLE 1

| No. | St/DMAM (Mole Ratio) | Tg (°C.) | Amine Value (KOH mg/g) |
|---|---|---|---|
| Reference 1 | 95/5 | 81 | 25 |
| Reference 2 | 90/10 | 76 | 50 |
| Reference 3 | 80/20 | 70 | 95 |
| Reference 4 | 60/40 | 56 | 174 |
| Reference 5 | 50/50 | 54 | 210 |
| Reference 6 | 30/70 | 40 | 273 |
| Reference 7 | 10/90 | 35 | 327 |

Embodiments

| Preparation of Toners (1 to 10) | |
|---|---|
| styrene-acrylic copolymerization resin (a softening point (Tm): 135° C., a glass transition point (Tg): 58° C.) | 100 parts by weight |
| copper phthalocyanine pigment (produced by Dainichi-Seika K. K.) | 6 parts by weight |
| Viscol 550 P (produced by Sanyo Kasei Kogyo K. K.) | 5 parts by weight |

The above-mentioned ingredients were sufficient mixed in a ball mill, thereafter being kneaded over a three-roller heated to 130° C. The kneaded mixture was left to stand for cooling it, and coarsely pulverized in a feather mill. Then, the obtained particles were further pulverized into fine particles under jet stream, followed by being air-classified to obtain an insulating toner i of an average particle diameter of 13 )m. One hundred parts by weight of the obtained toner i, and 0.4 parts by weight of nigrosine (Bontron N-01 produced by Orient Kagaku Kogyo K.K.) were agitated at 1500 rpm for 2 minutes with the use of a Henschel mixer of a capacity of 10 P , so that nigrosine was adhered to the surface of toner i. Next, the toner particles were dispersed into air stream heated to 120° C., and were instantaneously heated for 1 to 3 seconds to partially fuse the surface of the toner paritcle, so that nigrosine was fixed to the surface of the toner, resulting in obtaining positive-chargeable toner 1.

Insulating toner i was mixed with Bontron N-01 in each amount as shown in Table 2, and positive-charged toners 2 to 6 were obtained in the same manner as that of toner 1.

Further, insulating toner i was mixed with Spilon Black . TRH (Cr-containing oil color produced by (Hodogaya Kagaku K.K.) in each amount as shown in Table 2 to obtain negative-chargeable toners 7 to 10.

TABLE 2

| Positive-chargeable toner | Bontron N-01 (parts by weight) |
|---|---|
| 1 | 0.4 |
| 2 | 0.01 |
| 3 | 0.05 |
| 4 | 0.1 |
| 5 | 0.7 |
| 6 | 1.5 |
| **Negative-chargeable toner** | **Spilon Black TRH (parts by weight)** |
| 7 | 0.01 |
| 8 | 0.1 |
| 9 | 0.7 |
| 10 | 1.5 |

| Preparation of Toners (11 and 12) | |
|---|---|
| polyester resin (a softening point (Tm): 125° C., a glass transition point (Tg): 68° C., acid value (AV): 23) | 100 parts by weight |
| Fastogen Green S (produced by Mitsubishi Kasei Kogyo K. K.) | 7 parts by weight |
| Viscol TS - 200 (produced by Sanyo Kasei Kogyo K. K.) | 2 parts by weight |

The above ingredients were mixed sufficiently in a ball mill, and kneaded over a three-roll heated to 135° C. The kneaded mixture was left to stand for cooling the same, and then, was coarsely pulverized with the use of a feather mill. The obtained coarse particles were further pulverized under jet stream, followed by being air-classified to obtain insulating toner ii of an average particle diameter of 11.5 )m.

One hundred parts by weight of the obtained toner ii was mixed with Nigrosine Base EX (produced by Orient Kagaku Kogyo K.K.), or bontron S-34 (produced by Orient Kagaku Kogyo) in the amount as shown in Table 3, and toners 11 and 12 were obtained is the same manner as that of the preparation of toner (1).

TABLE 3

| Positive-Chargeable Toner | Nigrosine Base EX (parts by weight) |
|---|---|
| 11 | 0.5 |
| **Negative-Chargeable Toner** | **Bontron S-34 (parts by weight)** |
| 12 | 0.5 |

PREPARATION OF TONERS 13 AND 14

Toner 13 of an average particle diameter of 13 )m was prepared in the same manner as that of the preparation of toner 1 with the exceptation that 8 parts by weight of Symuler Fast Yellow 5 GF (produced by Dainippon Ink Kagaku Kogyo K.K.) was employed as a colorant instead of copper phthalocyanine.

Further, toner 14 was prepared in the same manner as that of the preparation of toner 13 with the exceptation that the amount of Bontron N-01 was varied as shown in Table 4.

TABLE 4

| Positive-Chargeable Toner | Bontron N-01 (parts by weight) |
|---|---|
| 13 | 0.4 |
| 14 | 1.3 |

PREPARATION OF TONER (15)

Toner 15 of an average particle diameter of 13 )m was obtained in the same manner as that of the preparation of toner 1 with the exceptation of 4 parts by weight of Lake Red C (produced by Dainichi-Seika K.K.) instead of copper phthalocyanine as a colorant, and 1 part by weight of Carbon Black MA#8 (produced by Mitsubishi Kasei Kogyo K.K.).

| Preparation of Toner (16) | |
|---|---|
| styrene | 60 parts by weight |
| n-butyl methacrylate | 35 parts by weight |
| methacrylic acid | 5 parts by weight |

-continued

| Preparation of Toner (16) | |
|---|---|
| 2,2'-azobis(2,4-dimethylvaleronitrile) | 0.5 parts by weight |
| low-molecular weight oxidizing type polypropylene [Viscol TS-200] (Produced by Sanyo Kasei Kogyo K. K.) | 3 parts by weight |
| Lake Red C (produced by Dainichi-Seika K. K.) | 5 parts by weight |

The above ingredients were mixed sufficiently with the use of a sand-stirrer to prepare of polymerizable composition. This polymerizable composition was mixed with an aqueous solution of arabic gum of a concentration of 3% by weight, and they were stirred at 3,000 rpm with the use of T. K AUTO HOMO MIXER (manufactured by Tokushukika Kogyosha K.K.) to polymerize them at the temperature of 60° C. for 6 hours, and they were heated to 80° C. and further polymerized them. After their polymerization, the system of reaction was rinsed five times, then, filtered, and dried, resulting in spherical particles.

The obtained spherical particle was 11.8 )m in the average particle size, 141° C. in the softening point (Tm), and 61° C. in the glass transition point (Tg). This spherical particle was reffered to as toner iii.

Toner 16 was prepared in the same manner as that of the preparation of toner 1, with the exceptation of employing 100 parts by weight of this toner iii and 0.5 part by weight of nigrosine dye, Bontron N-01 (produced by Orient Kagaku Kogyo K.K.) as a charge-giving agent.

PREPARATION OF TONER (17)

Toner 17 of an average particle size of 12.0 )m, of a softening point (Tm) of 141° C., and of a glass transition point (Tg) of 61° C. was obtained in the same manner as that of the preparation of toner 16 with the exceptation of the addition of 3 parts by weight of Nigrosine Base EX (produced by Orient Kagaku Kogyo K.K.).

PREPARATION OF TONER (18)

One hundred parts by weight of insulating toner i of an average particle diameter of 13 )m, and 0.5 parts by weight of nigrosine (Bontron N-01 produced by Orient Kagaku Kogyo K.K.) were mixed and stirred at 1,500 rpm for 2 minutes with the use of an O.M. dizer of hybridization system NHS—1 type (manufactured by Nara Kikai Seisakusho K.K.), so that the particles of nigrosine were adhered to the particle surface of insulating toner i. Then, the resultant toner with nigrosine was further stirred at 9,000 rpm for 3 minutes with the use of the same hybridizer of hybridization system, so that the particles of nigrosine were fixed to the particel surface of insulating toner i to obtain toner 18.

PREPARATION OF TONER (19)

One hundred parts by weight of monodisperse spherical particles of styrene polymer (an average particle diameter of 8 ) m, a glass transition point of 54° C., and a softening point of 128° C.) obtained through the seed polymerization , and 6 parts by weight of copper phthalocyanine pigment (produced by Dainichi-Seika Kogyo K.K.) were mixed and stirred at 9,000 rpm for 3 minutes with the use of a hybridizer of Hibridization system NHS-1 type (manufactured by Nara Kikai Seisakusho K.K.) so that the particles of copper phthalocyanine pigment were attached to the surface of the polymer particle.

One hundred parts by weight of the above pigment-attached polymer particles, and 10 parts by weight of fine particles of PMMA, MP-1451 (of a glass transition point of 125° C., produced by Soken Kagakusha K.K.) were mixed and stirred in the same manner as that of the above process, so that the surface of the polymer particle was coated with the PMMA resin. Furthermore, one hundred parts by weight of the obtained PMMA-coated polymer particles, and 0.5 parts by weight of nigrosine (Bontron N-01 produced by Orient Kagaku Kogyo ) as a positive-charge-controlling agent were mixed and stirred in the same manner as that of the above process, so that the particles of nigrosine were fixed to the surface of the polymer particle, resulting in toner (19) of an average particle diameter of 9 )m.

PREPARATION OF TONER (20)

| | |
|---|---|
| styrene-acrylic copolymer resin: (of a softening point(Tm) of 135° C., and a glass transition point of 58° C.) | 100 parts by weight |
| nigrosine dye, Bontron N-01: (produced by Orient Kagaku Kogyo K.K.) | 1 part by weight |

The above ingredients were homogeneously dispersed in a solvent of toluene by the aid of high shearing agitation, and then, insulating toner i as a core material is added thereto, and the obtained mixture was spray-dried according to the spray-drying method, so that the insulting toner was coated with the mixture of styren-acrylic copolymer resin and nigrosine (Bontron N-01), resulting in obtaining toner (20) of an average particle diameter of 14 )m.

| Preparation of Toner (21) (Comparison) | |
|---|---|
| styrene-acrylic copolymer resin (of a softening point of 135° C., and of a glass transition point of 58° C.) | 100 parts by weight |
| copper phthalocyanine blue (produced by Dainippon Ink Kagaku Kogyo K. K.) | 5 parts by weight |
| Viscol 550P (produced by Sanyo Kasei Kogyo K. K.) | 5 parts by weight |
| nigrosine dye, Bontron N-01 (produced by Orient Kagaku Kogyo K. K.) | 3 parts by weight |

The above ingredients were processed in the same manner as that of the preparation of insulating toner i to obtain toner (21) of an average particle diameter of 13 )m.

| Preparation of Toners (22 to 27) | |
|---|---|
| styrene-acrylic copolymer resin (of a softening point of 135° C., a glass transition point of 58° C.) | 100 parts by weight |
| styrene-aminoacrylic resin (Reference 4) | 2 parts by weight |
| copper phthalocyanine pigment (produced by Dainichi-Seika Kogyo K. K.) | 6 parts by weight |
| Viscol 550P (produced by Sanyo Kasei Kogyo K. K.) | 5 parts by weight |

The above ingredients were mixed sufficiently with the use of a ball mill, and the obtained mixture was kneaded over the three-roll mill heated to 130° C. The obtained kneaded mixture was left to stand for cooling the same, and then, was pulverized into coarse particles with the use of a feather mill, and the coarse particles were further pulverized into fine particles under a jet stream. The obtained fine particles were air-classified to obtain toner iv of an average particle size of 13 ) m.

One hundred parts by weight of the obtained toner iv, and 0.4 parts by weight of nigrosine (Bontron N-01 produced by Orient Kagaku Kogyo K.K.) were mixed and stirred at 1,500 rpm for 2 minutes in a henschel mixer of a capacity of 10 P, so that the particles of nigrosine were adhered to the surface of the toner particles. Next, the obtained toner particles were dispersed into an air currrent heated to 120° C., and were instantaneously heated for about 1 to 3 seconds to partially fuse the surfaces of toner particles, so that the particles of nigrosine were fixed to the surfaces of toner particles to obtain toner 22.

Toners 22 to 27 were obtained in the same manner as that of the above process, with the exceptation of the addition of Botron N-01 in each amount as shown in Table 5, so that the particles of Bontron N-01 were fixed to the surface of the toner particles.

TABLE 5

| Positive-chargeable toner | Bontron N-01 (parts by weight) |
|---|---|
| 22 | 0.4 |
| 23 | 0.005 |
| 24 | 0.05 |
| 25 | 0.1 |
| 26 | 0.7 |
| 27 | 1.5 |

| Preparation of Toner (28) | |
|---|---|
| styrene-acrylic copolymer resin (of a softening point (Tm) of 135° C., and a glass transition point (Tg) of 58° C.) | 100 parts by weight |
| quarternary ammonium salt p-51 (produced by Orient Kagaku Kogyo K. K.) | 2 parts by weight |
| Lake Red C (produced by Dainichi-Seika Kogyo K. K.) | 4 parts by weight |
| Carbon Black MA#8 (produced by Mitsubishi Kasei Kogyo K. K.) | 1 part by weight |
| Viscol 550P (produced by Sanyo Kasei Kogyo K. K.) | 5 parts by weight |

The above ingredients were processed in the same manner as that of the process of toner iv to obtain toner v of an average particle size of 14 )m. One hundred parts by weight of the obtained toner v, and 0.5 parts by weight of Nigrosine Base EX (produced by Orient Kagaku Kogyo K.K.) were processed in a henschel mixer of a capacity of 10 P in the same manner as that of the process of positive chargeable toner 22, so that the particles of nigrosine were fixed to the surface of the toner particle to obtain toner 28.

PREPARATON OF TONER 29

| | |
|---|---|
| styrene-acrylic copolymer resin (of a softenting point of 135° C., and a glass transition point of 58° C.) | 100 parts by weight |
| styrene-acrylic resin (Reference 2) | 2 parts by weight |
| quarternary ammonium salt P-51 (produced by Orient Kagaku Kogyo) | 1 part by weight |
| Symuler Fast Yellow 5GF | 8 parts by weight |

The above ingredients were processed in the same manner as that of toner iv to obtain toner vi of an average particle size of 13 )m. One hundred parts by weight of the obtained toner vi, and 0.4 parts by weight of Nigrosine Base EX (produced by Orient Kagaku Kogyo K.K.) were processed in a henschel mixer of a capacity of 10 P in the same manner as that of the process of toner 22, so that the particles of nigrosine were fixed to the surface of toner particle to obtain positive-chargeable toner 29.

PREPARATION OF TONER (vii)

With the same ingredients plus the same manner as those of positive-chargeable toner iv excepting 30 parts by weight of styrene-aminoacrylic resin (Reference 4), positive-chargeable toner vii of an average particle size of 13 )m was obtained.

PREPARATION OF TONER (viii)

With the same ingredients plus the same manner as those of toner v excepting 10 parts by weight of quarternary ammonium salt P-51 (produced by Orient Kagaku Kogyo K.K.), positive-chargeable toner viii of an average particle size of 13 )m was obtained.

PREPARATION OF TONER (ix)

With the same ingredients plus the same manner as those of toner vi excepting 20 parts by weight of styrene-aminoacrylic copolymer resin (Reference 2), and 5 parts by weight of quarternary ammonium salt P-51 (produced by Orient Kagaku Kogyo K.K.), positive-chargeable toner ix of an average particle size of 13 )m was obtained.

PREPARATION OF TONER (30 TO 33)

One hundred parts by weight of toner ix was mixed with Nigrosine Base EX (produced by Orient Kagaku Kogyo K.K.) in each amount as shown in Table 6, and they were processed in a henschel mixer of a capacity of 10 P in the same manner as that of the fixed to the surface of the toner particle ix.

TABLE 6

| Positive-Chargeable Toner | Nigrosine Base EX (parts by weight) |
|---|---|
| 30 | 0.005 |
| 31 | 0.01 |
| 32 | 0.05 |
| 33 | 0.07 |

PREPARATION OF TONER (34)

With the same ingredients plus the same manner as those of toner iv expecting the addition of 0.5 parts by weight of nigrosine (Bontron N-01 produced by Orient Kagaku Kogyo K.K.), positive-chargeable toner 34 of an average particle size of 13 )m was obtained.

PREPARATION OF TONER (35)

With the same ingredients plus the same manner as those of toner 28 excepting the employment of 2 parts by weight of phenothiazine compound (produced by Sumitomo Kagaku Kogyo K.K.) instead of quarternary ammonium salt P-51, positive-chargeable toner 35 of an average particle diameter of 13 )m was obtained.

PREPARATION OF TONER (36)

| | |
|---|---|
| styrene | 60 parts by weight |
| n-butyl methacrylate | 30 parts by weight |
| 2,2,3,3-tetrafluoro propylacrylate | 5 parts by weight |
| 2,2'-azobis(2,4-dimethylvaleronitrile) | 0.5 parts by weight |
| low-molecular-weight oxidizing type polypropylene [Viscol TS-200] (produced by Sanyo Kasei Kogyo K. K.) | 3 parts by weight |
| Lake Red C (produced by Dainichi-Seika Kogyo K. K.) | 5 parts by weight |

The above ingredients were sufficiently mixed with the use of a sand-stirrer to prepare a polymerizable composition. The obtained polymerizable composition was added to an aqueous solution of arabic gum of a concentration of 3% by weight with being stirred at 2,500 rpm with the use of a stirring mill, T.K. AUTO HOMO MIXER (manufactured by Tokushukika Kogyo K.K.), and the obtained liquid mixture was stirred at 80 rpm with the use of an conventional stirring mill to be polymerized at a temperature of 60° C. for 6 hours. The polymerized mixture was further heated to 80° C., at which it was further polymerized. After these polymerization reactions, the obtained reactive mixture was cooled, then rinsed 5 times, filtered, and dried to obtain spherical particles of an average particle size of 13.3 )m. These particles are named as toner x. This toner x was 141° C. in the softening point (Tm), and 61° C. in the glass transition point (Tg). Toner 36 is obtained in the same manner as that of the process of toner 22 with the exceptation of the employment of 100 parts by weight of particles of toner x, and 0.1 part by weight of nigrosine, Bontron N-01 (produced by Orient Kagaku Kogyo K.K.) as a charge-giving agent.

PREPARATION OF TONERS (37 TO 39)

| | |
|---|---|
| styrene-acrylic copolymer resin (of a softening point (Tm) of 135° C., and a glass transition point (Tg) of 58° C.) | 100 parts by weight |
| styrene/butylacrylate/ 2,2,2-trifluoroethylacrylate = 70/15/15 | 10 parts by weight |
| copper phthalocyanine pigment (produced by Dainichi-Seika Kogyo K. K.) | 6 parts by weight |
| Viscol 550P (produced by Sanyo Kasei Kogyo K. K.) | 5 parts by weight |

The above ingredients were sufficiently mixed in a ball mill, and kneaded over a three-roll mill heated to 130° C. The kneaded mixture was left to stand for cooling the same, and was pulverized into coarse particles with the use of a feather mill, and the coarse particles were further pulverized into fine particles under a jet stream. The obtained fine particles were air-classified to obtain toner xi of an average particle size of 13 )m. One hundred parts by weight of the obtained toner xi, and 0.5 parts by weight of chrome complex salt type dye, Spilon Black TRH (produced by Hodogaya Kagaku K.K.) were stirred at 1,500 rpm for 2 minutes in a henschel mixer of a capacity of 10 P , so that the particles of Spilon Black TRH were adhered to the particle surface of toner xi. Next, the obtained particles were dispersed into an air current heated to 200° C., and were instantaneously heated for about 1 to 3 seconds, so that the surface of toner particle was partially fused, thereby fixing the particles of chrome complex salt type dye. Thus, negative-chargeable toner 37 was obtained.

In the same manner as that of the above process, the particles of Spilon Black TRH were fixed to the particle surface of toner xi in each amount as shown in Table 7, so that negative-charageable toners 38 an d39 were obtained.

TABLE 7

| Negative-Chargeable Toner | Spilon Black TRH (parts by weight) |
|---|---|
| 37 | 0.5 |
| 38 | 0.1 |
| 39 | 1.5 |

| Preparation of Toner (40) | |
|---|---|
| styren-acrylic copolymer resin (of a softening point (Tm) of 135° C., and a glass transition point (Tg) of 58° C.) | 100 parts by weight |
| styrene/butylacrylate/2,2,2-trifluoroethyl-acrylate = 70/15/15 | 10 parts by weight |
| styrene/butylacrylate/2,2,3,3-tetrafluoropropyl-acrylate = 75/25/5 | 5 parts by weight |
| Symuler Fast Yellow 5GF | 8 parts by weight |
| Viscol 550P (produced by Sanyo Kasei Kogyo K. K.) | 5 parts by weight |

The above ingredients were processed in the same manner as that of the process of toner xi to obtain negative chargeable toner xii of an average particle size of 14 )m. One hundred parts by weight of the obtained toner xii, and 0.5 parts by weight of S-34 (produced by Orient Kagaku Kogyo K.K.) were processed in a henschel mixer of a capacity of 10 P in the same manner as that the process of toner 37, so that the particles of the chrome complex salt type dye were fixed to the particle surface of toner to obtain negative-chargeable toner 40.

PREPARATION OF TONER (41)

| | |
|---|---|
| styrene | 60 parts by weight |
| n-butylmethacrylate | 25 parts by weight |
| 2,2,2-trifluoroethylacrylate | 15 parts by weight |
| 2,2'-azobis(2,4-dimethylvaleronitrile) | 0.5 parts by weight |
| low-molecular-weight polypropylene [Viscol 550P] (produced by Sanyo Kasei Kogyo K. K.) | 3 parts by weight |
| red pigment, Lake Red C (produced by Dainichi-Seika Kogyo K. K.) | 5 parts by weight |

The above ingredients were sufficiently mixed with the use of a sand-stirrer to prepare a polymerizable composition. The obtained polymerizable composition was dispersed into an aqueous solution of arabic gum of a concentration of 3% by weight, and they were polymerized at a temperature of 60° C. for 6 hours with being stirred at 3,000 rpm with the use of a stirring means, T.K AUTO HOMO MIXER (manufactured by Tokushukika Kogyo K.K.). Then, they were heated to 80° C., at which they were further polymerized. After these polymerization, the reactive mixture was cooled, rinsed 5 times, filtered, and dried to obtain spherical particles.

The obtained spherical particle was 11.6 )m in the average particle diameter, 144° C. in the softening point (Tm), and 64° C. in the glass transition point (Tg). These particles were named as toner xiii.

Toner 41 was obtained in the same manner as that of the process of toner 19 with the exceptation of the employment of 100 parts by weight of toner xiii, and 0.5 part by weight of chrome complex salt type dye, Spiron Black TRH (produced by Hodogaya Kagaku Kogyo K.K.).

PREPARATION OF TONER (42)

| | |
|---|---|
| styrene-acryric copolymer resin (of a softening point (Tm) of 122° C., and a glass transition point (Tg) of 57° C.) | 100 parts by weight |
| copper phthalocyanine pigment (produced by Dainichi-Seika Kogyo K. K.) | 5 parts by weight |
| Viscol 330P (produced by Sanyo Kasei Kogyo K. K.) | 2.5 parts by weight |

The above ingredients were processed in the same manner as that of the process of toner i in course of the preparation of toner 1, and an insulating toner of an average particle size of 12.5 )m was obtained.

One hundred parts by weight of said insulating toner, and 0.4 part by weight of Nigrosine Base EX were processed in the same manner as that of the preparation of toner 1, so that the particles of Nigrosine Base EX were fixed to the surface of the insulating toner particle. Thus, positive-chargeable color toner 42 was obtained.

TABLE 8

| Negative-Chargeable Toner | Bontron S-34 (parts by weight) |
|---|---|
| 42 | 0.4 |

PREPARATION OF MICROCARRIER

The carrier composing the developer employed in the examples was a binder type carrier, which is provided as follows:

| | |
|---|---|
| magnetite (BL-SP produced by Titan Kogyo K. K.) | 500 parts by weight |
| styrene-acrylic copolymer resin (Plyorite ACL produced by Good Year Chemical Co., Ltd.) | 100 parts by weight |
| silica #200 (produced by Nippon Aerogil K. K.) | 2 parts by weight |

The above ingredients were mixed sufficiently with the use of a super mixer, and kneaded with the use of a twin-screw extruding kneader. After that, the kneaded mixture were cooled, then pulverized into coarse particles, and the coarse particles were further pulverized into fine particles of an average paricle size of 50 )m with the use of a hammer mill, which were air-classified into coarse particles and fine ones, so that a microcarrier of an average particle size of 40 )m was obtained. The specific gravity of the obtained particle was 3.3.

PREPARATION OF A DEVELOPER AND MEASUREMENT OF CHARGE AMOUNT AND FLYING AMOUNT

One hundred parts by weight of each of the above-mentioned toners 1 to 42 and i to xiii were subjected to surface treatment with 0.1 part by weight of Colloidal Silica R-972 (produced by Nippon Aerogile K.K.), however, in this case, the particles of colloidal Silica were not fixed to the surface of a toner particle. Each five g of the surface-treated toner, and 27 g of microcarrier were put in a poly bottle of a capacity of 50 cc, and were stirred respectively for 3 minutes, 10 minutes, and 30 minutes. Then, the resultant charge amount and flying amount were measured so as to examine the electrification-build-up properties of the toner after the poly bottle was rotated on a rotating carriage at 120 rpm.

The flying amount was measured with the use of a digital dust measuring apparatus of P5H2 type (manufactured by Shibata Kagakusha K.K.). The dust measuring apparatus was spaced 10 cm apart from a magnet roll, and 2 g of the developer was set on the magnet roll, which was rotated at 2,000 rpm. Then, the dust measuring apparatus detected the toner paritcles flying about as dust, and displayed the resultant value in the number of counts per minute, i.e. cpm.

In this connection, the target value of the practical level for flying amount was less than 500 cpm.

TURBIDITY-MEASUREMENT OF A COLOR IMAGE ON A COPYING SHEET CAUSED BY THE CHARGE-GIVING AGENT

The chroma of a color image on a copying sheet which was reproduced from each of color toners was measured with the use of a color difference measuring apparatus CR-100 (manufactured by Minolta Camera K.K.). The difference in chroma between a nigrosine-employing color toner and a color toner not employing nigrosine was detected, and through such a detection, the difference in chroma therebetween was estimated. In connection, ◎, ○, × were expressed respectively as follows:

◎: There was little turbidity in color.

○: Turbidity in color, it was so unnoticeable that it could be available for practical use.

×: Turbidity in color was extremely noticeable.

DETERMINATION OF NIGROSINE BASE EX ACCORDING TO THE ABSORPTION PHOTOMETRY (1) The solutions of Nigrosine Base EX in quaranteed ethanol produced by Woko Junyaku Kogyo K.K. were parepared at various concentrations. Then, the absorbance of each of the prepared solutions was measured with respect to gmax=567 nm with the-use of a spectrphotometer. Based on the obtained absorbances, a calibration curve as shown in FIG. 1 was drawn.

(2) The toner as a sample was precisely weighed with the scale on and around 50 mg. The weighed tonner was immersed in 25 ml of ethanol, and they were shaked for proper hours to elute Nigrosine Base EX from the surface of the toner. Since an ethanol solvent had a hard soluble property against a resin and other components, such a property could be useful for this measurement.

(3) The resultant eluent was filtered through a filter paper of No. 2 to separate the same into the residual toner and the eluted filtrate.

(4) The absorbance of the separated eluent was measured with respect to gmax=567 nm with the use of a spectrophotometer in the same manner as that of the measurement of 1, so that a relevent calibration curve could be obtained. The quantitative analysis of Nigrosine Base EX per unit toner weight was carried out based on the above calibration curve and the amount of toner sample precisely weighed in the step of (2).

On the other hand, the quantitative analysis of Spilon Black TRH employed as a charge-giving agent was carried out according to the same method as the above-mentioned case. In this connection, the quantitative analysis of Spilon Black TRH was carried out by obtaining its absorbance with respect to g max=577 nm.

FIG. 2 shows the calibration curve of the solutions containing Spilon Black TRH.

Tables 9 and 10 show the results of the measurement of the charge amount, flying amount, turbidity in color, and the amount of the charge-giving agent fixed to the toner surface, Table 9 shows the estimation results of the toners which can satisfy the requirements of the present invention, and Table 10 shows the estimation results of the toners which can not sufficiently satisfy the requirements of the present invention.

TABLE 10

| | | 3 minutes | | 10 minutes | | 30 minutes | | Surface | Addition | |
|---|---|---|---|---|---|---|---|---|---|---|
| ** | Toner | Charge amount (μc/g) | Flying amount (cpm) | Charge amount (μc/g) | Flying amount (cpm) | Charge amount (μc/g) | Flying amount (cpm) | attaching amount (wt %) | amount (parts by weight) | Turbidity in Color Image |
| C1 | 2 | 2 | 2368 | 6 | 2248 | 6 | 2244 | 0.008 | 0.01 | ◎ |
| C2 | 6 | 24 | 76 | 25 | 73 | 26 | 72 | 1.24 | 1.5 | x |
| C3 | 7 | 4 | 2531 | 5 | 2530 | 4 | 2498 | 0.005 | 0.01 | ◎ |
| C4 | 10 | −25 | 77 | −26 | 73 | −28 | 69 | 1.27 | 1.5 | x |
| C5 | i | 1 | 3720 | 2 | 3578 | 2 | 3599 | — | — | ◎ |
| C6 | ii | −5 | 2162 | −6 | 2103 | −8 | 2087 | — | — | ◎ |
| C7 | iii | 1 | 3873 | 2 | 3871 | 1 | 3868 | — | — | ◎ |
| C8 | 14 | 23 | 83 | 25 | 81 | 24 | 80 | 1.04 | 1.3 | x |
| C9 | 17 | 5 | 2421 | 6 | 2403 | 6 | 2400 | | (3.0) | x |
| C10 | 20 | 3 | 2998 | 2 | 3013 | 2 | 3073 | | (1.0) | ○ |
| C11 | 21 | 11 | 387 | 12 | 381 | 12 | 366 | | (3.0) | x |
| C12 | iv | 3 | 2897 | 3 | 2863 | 4 | 2868 | — | — | ◎ |
| C13 | 23 | 4 | 2261 | 5 | 2181 | 4 | 2183 | 0.004 | 0.005 | ◎ |
| C14 | 27 | 24 | 73 | 25 | 71 | 24 | 72 | 1.26 | 1.5 | x |
| C15 | v | 4 | 2333 | 3 | 2349 | 4 | 2341 | — | — | ◎ |
| C16 | vi | 6 | 1871 | 7 | 1856 | 7 | 1849 | — | — | ◎ |
| C17 | vii | 4 | 2058 | 6 | 2003 | 7 | 1987 | — | — | ◎ |
| C18 | viii | 3 | 2172 | 6 | 2001 | 7 | 1991 | — | — | ◎ |
| C19 | ix | 4 | 1998 | 6 | 1871 | 8 | 1700 | — | — | ◎ |
| C20 | 30 | 6 | 1463 | 8 | 1388 | 7 | 1381 | 0.004 | 0.005 | ◎ |
| C21 | 34 | 3 | 2005 | 4 | 1986 | 4 | 1981 | | 0.5 | ◎ |
| C22 | 35 | 3 | 2137 | 2 | 2231 | 2 | 2229 | — | — | ◎ |
| C23 | x | −2 | 2241 | −3 | 2032 | −3 | 1989 | — | — | ◎ |
| C24 | xi | −3 | 2356 | −4 | 2171 | −4 | 2096 | — | — | ◎ |
| C25 | 39 | −26 | 69 | −28 | 68 | −28 | 66 | 1.21 | 1.5 | x |
| C26 | xii | −4 | 2012 | −5 | 1988 | −6 | 1881 | — | — | ◎ |

TABLE 10-continued

| ** | Toner | 3 minutes Charge amount (μc/g) | 3 minutes Flying amount (cpm) | 10 minutes Charge amount (μc/g) | 10 minutes Flying amount (cpm) | 30 minutes Charge amount (μc/g) | 30 minutes Flying amount (cpm) | Surface attaching amount (wt %) | Addition amount (parts by weight) | Turbidity in Color Image |
|---|---|---|---|---|---|---|---|---|---|---|
| C27 | xiii | −3 | 2231 | −4 | 2146 | −4 | 2140 | — | — | ◎ |

**C: Example to be compared

TABLE 9

| * | Toner | 3 minutes Charge amount (μc/g) | 3 minutes Flying amount (cpm) | 10 minutes Charge amount (μc/g) | 10 minutes Flying amount (cpm) | 30 minutes Charge amount (μc/g) | 30 minutes Flying amount (cpm) | Surface attaching amount (wt %) | Addition amount (parts by weight) | Turbidity in Color Image |
|---|---|---|---|---|---|---|---|---|---|---|
| E1 | 1 | 16 | 98 | 16 | 96 | 17 | 91 | 0.37 | 0.4 | ◎ |
| E2 | 3 | 10 | 241 | 11 | 238 | 11 | 235 | 0.04 | 0.05 | ◎ |
| E3 | 4 | 12 | 197 | 13 | 181 | 12 | 180 | 0.08 | 0.1 | ◎ |
| E4 | 5 | 19 | 89 | 20 | 87 | 20 | 84 | 0.61 | 0.7 | ◎ |
| E5 | 8 | −13 | 195 | −14 | 190 | −13 | 191 | 0.08 | 0.1 | ◎ |
| E6 | 9 | −20 | 87 | −21 | 81 | −22 | 80 | 0.6 | 0.7 | ◎ |
| E7 | 11 | 16 | 93 | 17 | 91 | 16 | 90 | 0.41 | 0.5 | ◎ |
| E8 | 12 | −19 | 82 | −20 | 80 | −21 | 78 | 0.42 | 0.5 | ◎ |
| E9 | 13 | 16 | 101 | 17 | 98 | 16 | 97 | 0.34 | 0.4 | ◎ |
| E10 | 15 | 17 | 100 | 18 | 93 | 18 | 91 | 0.32 | 0.4 | ◎ |
| E11 | 16 | 17 | 118 | 18 | 103 | 18 | 101 | 0.42 | 0.5 | ◎ |
| E12 | 18 | 18 | 94 | 19 | 92 | 19 | 90 | 0.41 | 0.5 | ◎ |
| E13 | 19 | 19 | 89 | 20 | 87 | 19 | 86 | 0.41 | 0.5 | ◎ |
| E14 | 22 | 18 | 77 | 19 | 76 | 19 | 73 | 0.32 | 0.4 | ◎ |
| E15 | 24 | 11 | 203 | 12 | 197 | 12 | 191 | 0.04 | 0.05 | ◎ |
| E16 | 25 | 15 | 137 | 15 | 131 | 16 | 127 | 0.08 | 0.1 | ◎ |
| E17 | 26 | 21 | 68 | 22 | 65 | 23 | 61 | 0.58 | 0.7 | ◎ |
| E18 | 28 | 18 | 98 | 19 | 93 | 19 | 91 | 0.42 | 0.5 | ◎ |
| E19 | 29 | 18 | 88 | 19 | 83 | 20 | 80 | 0.33 | 0.4 | ◎ |
| E20 | 31 | 7 | 563 | 10 | 381 | 11 | 370 | 0.008 | 0.01 | ◎ |
| E21 | 32 | 13 | 267 | 14 | 253 | 14 | 242 | 0.042 | 0.05 | ◎ |
| E22 | 33 | 14 | 131 | 15 | 123 | 15 | 127 | 0.058 | 0.07 | ◎ |
| E23 | 36 | 14 | 152 | 15 | 150 | 14 | 149 | 0.26 | 0.3 | ◎ |
| E24 | 37 | −20 | 81 | −21 | 79 | −22 | 77 | 0.42 | 0.5 | ◎ |
| E25 | 38 | −16 | 112 | −17 | 102 | −18 | 97 | 0.08 | 0.1 | ◎ |
| E26 | 40 | −19 | 102 | −18 | 100 | −20 | 96 | 0.42 | 0.5 | ◎ |
| E27 | 41 | −21 | 84 | −21 | 81 | −22 | 78 | 0.42 | 0.5 | ◎ |
| E28 | 42 | 15 | 198 | 16 | 185 | 17 | 157 | 0.31 | 0.4 | ◎ |

*E: Example

MEASUREMENT OF CHARGE DISTRIBUTION

For the measurement of charge distribution, was employed the apparatus published by Mr. Terasaka, et al. of Minolta Camera K.K., in the 58th Meeting for Reading Paper held by the Academy of Electrophotography on Nov. 28 in 1986. Since the theory of the apparatus is described in detail in the pamphlet distributed in the meeting, it is described briefly in this application. FIG. 3 shows its construction.

The measuring procedures are followed as bellow.

The number of revolutions of magnet roll (3) was set to 100 rpm, and as a developer, was employed one prepared by stirring for 30 minutes. The developer was weighed in 3 g on a precision balance, and put uniformly on the entire surface of conductive sleeve (2). Then, bias supply (4) applied zero to 10 KV of bias voltage sequentially, the sleeve (2) was then rotated for 5 seconds. After sleeve (2) was stopped, electrical potential Vm was read. In this step, the amount Mi of toner (7) attached to cylindrical electrode (1) was weighed on the precision balance to calculate the average charge amount of toner. FIG. 4 is a graph in which the weight percentage of toner mass calculated in the above way is expressed by the axis of ordinate, and the charge amount Q/M is expressed as a logarithm by the axis of abscissa. FIG. 4 shows the results of the measurement of toner 1.

In FIG. 4, one division into which the range of $10^0$ to $10^2$ of the axis of abscissa (Q/M) is divided by 20 is taken as one channel, and the accumulated weight percentage of 3 channels which are in order of the larger weight percentage of this channel is calculated. The resultant accumulated weight percentage for each toner is shown in Table 11.

TABLE 11

| | Toner | the accumulated % by weight |
|---|---|---|
| E1 | 1 | 97 |
| E2 | 3 | 90 |
| E3 | 4 | 92 |
| E4 | 5 | 97 |
| E5 | 8 | 92 |
| E6 | 9 | 96 |
| E7 | 11 | 97 |
| E8 | 12 | 98 |
| E9 | 13 | 97 |
| E10 | 15 | 97 |
| E11 | 16 | 95 |
| E12 | 18 | 97 |
| E13 | 19 | 97 |
| E14 | 22 | 98 |
| E15 | 24 | 91 |
| E16 | 25 | 93 |
| E17 | 26 | 98 |
| E18 | 28 | 97 |
| E19 | 29 | 96 |
| E20 | 31 | 87 |
| E21 | 32 | 93 |
| E22 | 33 | 98 |
| E23 | 36 | 93 |
| E24 | 37 | 97 |
| E25 | 38 | 95 |

TABLE 11-continued

| | Toner | the accumulated % by weight |
|---|---|---|
| E26 | 40 | 96 |
| E27 | 41 | 97 |
| E28 | 42 | 95 |
| C1 | 2 | 39 |
| C2 | 6 | 96 |
| C3 | 7 | 45 |
| C4 | 10 | 96 |
| C5 | i | 39 |
| C6 | ii | 40 |
| C7 | iii | 34 |
| C8 | 14 | 93 |
| C9 | 17 | 47 |
| C10 | 20 | 39 |
| C11 | 21 | 64 |
| C12 | iv | 41 |
| C13 | 23 | 43 |
| C14 | 27 | 96 |
| C15 | v | 44 |
| C16 | vi | 61 |
| C17 | vii | 60 |
| C18 | viii | 59 |
| C19 | ix | 40 |
| C20 | 30 | 62 |
| C21 | 34 | 61 |
| C22 | 35 | 40 |
| C23 | x | 39 |
| C24 | xi | 59 |
| C25 | 39 | 96 |
| C26 | xii | 63 |
| C27 | xiii | 53 |

TEST OF COPYING RESISTANCE

One hundred parts by weight of the above-mentioned carrier and 10 parts by weight of the bellow-mentioned toner were mixed to prepare a developer of two-component system.

The obtained developer was tested regarding its copying resistance with the use of the EP-470 or EP-570 manufactured by Minolta Camera K.K. so as to estimate the charge amounts and fog at the initial stage and during the copying operation respectively. Their results were shown in Table 12.

The degree of the fog was ranked based on the estimation of the obtained color image.

◎: There was little fog appeared on a copying sheet.

○: It was unnoticeable in actual use.

Δ: It was noticeable.

×: It was extremely noticeable.

The image density was estimated with the use of the Sakura reflection desity measuring apparatus. In this connection, color images were estimated based on the measurement with the use of adequate color filters.

With the exception of example 11 to be compared, the copying resistance test of the developers was suspended since the fog in image was increased during the test.

TABLE 12

| | | Initial Stage | | | 1,000 sheets | | 5,000 sheets | | 10,000 sheets | | 50,000 sheets | |
|---|---|---|---|---|---|---|---|---|---|---|---|---|
| | Toner | Charge amount (μc/g) | Rank of the fog | I.D. | Charge amount (μc/g) | Rank of the fog | Charge amount (μc/g) | Rank of the fog | Charge amount (μc/g) | Rank of the fog | Charge amount (μc/g) | Rank of the fog |
| E1 | 1 | 16 | ◎ | 1.3 | 16 | ◎ | 17 | ◎ | 17 | ◎ | 17 | ◎ |
| E2 | 3 | 10 | ○ | 1.4 | 11 | ○ | 11 | ○ | 11 | ○ | 11 | ○ |
| E3 | 4 | 12 | ◎ | 1.3 | 13 | ◎ | 14 | ◎ | 14 | ◎ | 14 | ◎ |
| E4 | 5 | 19 | ◎ | 1.2 | 20 | ◎ | 20 | ◎ | 19 | ◎ | 19 | ◎ |
| E6 | 9 | −20 | ◎ | 1.2 | −21 | ◎ | −22 | ◎ | −22 | ◎ | −22 | ◎ |
| E7 | 11 | 16 | ◎ | 1.3 | 17 | ◎ | 17 | ◎ | 16 | ◎ | 16 | ◎ |
| E8 | 12 | −19 | ◎ | 1.2 | −20 | ◎ | −21 | ◎ | −21 | ◎ | −21 | ◎ |
| E11 | 16 | 17 | ◎ | 1.3 | 18 | ◎ | 18 | ◎ | 17 | ◎ | 17 | ◎ |
| E12 | 18 | 18 | ◎ | 1.3 | 19 | ◎ | 19 | ◎ | 20 | ◎ | 19 | ◎ |
| E13 | 19 | 19 | ◎ | 1.2 | 20 | ◎ | 21 | ◎ | 20 | ◎ | 19 | ◎ |
| E14 | 22 | 18 | ◎ | 1.3 | 19 | ◎ | 19 | ◎ | 20 | ◎ | 21 | ◎ |
| E15 | 24 | 11 | ○ | 1.4 | 12 | ○ | 12 | ○ | 12 | ○ | 13 | ○ |
| E16 | 25 | 15 | ◎ | 1.3 | 15 | ◎ | 14 | ◎ | 15 | ◎ | 16 | ◎ |
| E17 | 26 | 21 | ◎ | 1.2 | 22 | ◎ | 23 | ◎ | 24 | ◎ | 22 | ◎ |
| E19 | 29 | 18 | ◎ | 1.2 | 19 | ◎ | 19 | ◎ | 20 | ◎ | 20 | ◎ |
| E20 | 31 | 11 | ○ | 1.2 | 12 | ○ | 12 | ○ | 13 | ○ | 13 | ○ |
| E21 | 32 | 14 | ◎ | 1.4 | 14 | ◎ | 15 | ◎ | 13 | ○ | 11 | ○ |
| E22 | 33 | 15 | ◎ | 1.4 | 16 | ◎ | 16 | ◎ | 16 | ◎ | 16 | ◎ |
| E23 | 36 | 14 | ◎ | 1.3 | 15 | ◎ | 15 | ◎ | 14 | ◎ | 15 | ◎ |
| E24 | 37 | −21 | ◎ | 1.2 | −22 | ◎ | −22 | ◎ | −23 | ◎ | −23 | ◎ |
| C1 | 2 | 5 | Δ | 1.1 | 6 | x | — | — | — | — | — | — |
| C9 | 17 | 6 | Δ | 1.1 | 5 | x | — | — | — | — | — | — |
| C10 | 20 | 3 | x | 0.7 | — | — | — | — | — | — | — | — |
| C11 | 21 | 11 | ○ | 1.4 | 12 | ○ | 11 | ○ | 9 | Δ | 7 | Δ |
| C12 | iv | 3 | x | 0.6 | — | — | — | — | — | — | — | — |
| C13 | 23 | 4 | Δ | 0.7 | 4 | x | — | — | — | — | — | — |
| C16 | vi | 6 | Δ | 1.0 | 8 | Δ | 9 | x | — | — | — | — |
| C19 | ix | 7 | x | 0.8 | 8 | x | — | — | — | — | — | — |
| C20 | 30 | 8 | x | 0.9 | 9 | x | — | — | — | — | — | — |
| C23 | x | −2 | x | 0.7 | — | — | — | — | — | — | — | — |
| C24 | xi | −3 | x | 0.7 | — | — | — | — | — | — | — | — |

EFFECTS OF THE INVENTION

The toner according to the present invention is narrow in charge distribution, and stable in charge amount, so that the fog and flying of toner are not caused.

Furthermore, in the present invention, when a necessary amount of charge-giving colored agent is applied to the surface of a toner particle, the reproduced color image has no fog, and is distinct in color without any turbidity.

Figure 1:
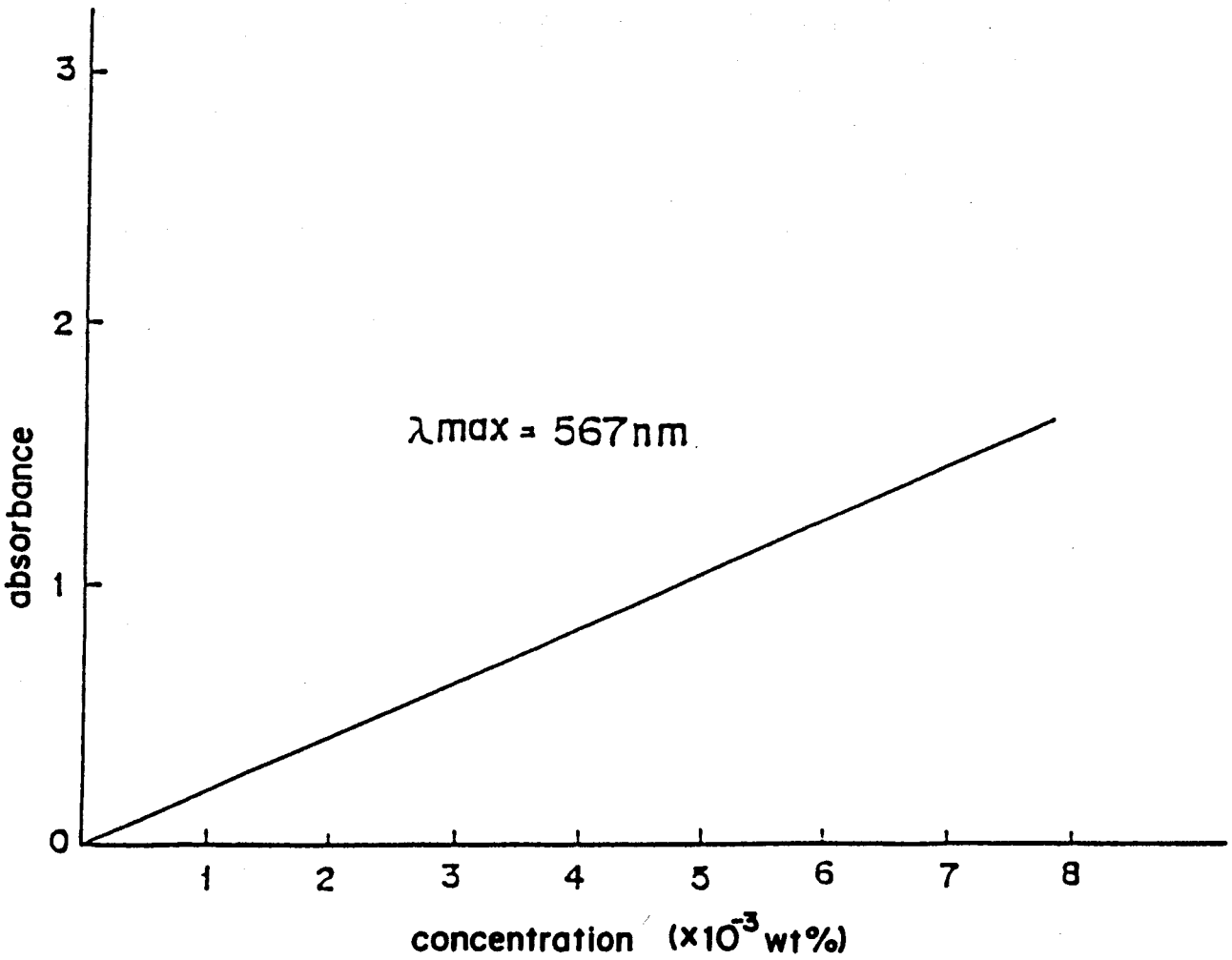
FIGS. 1 and 2 are graphs showing the calibration curves used in measuring the absorbance.
Figure 2:
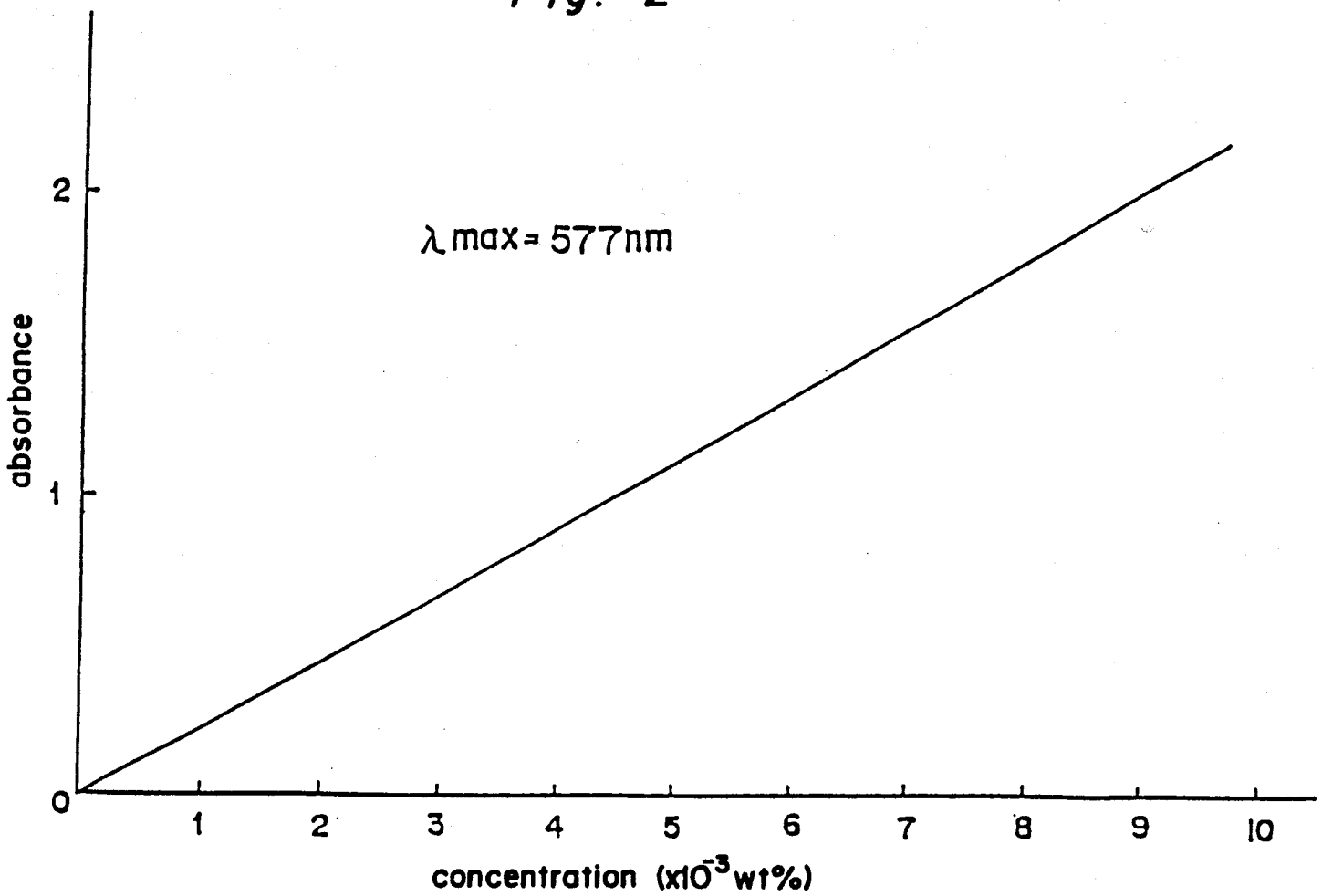
Figure 3:
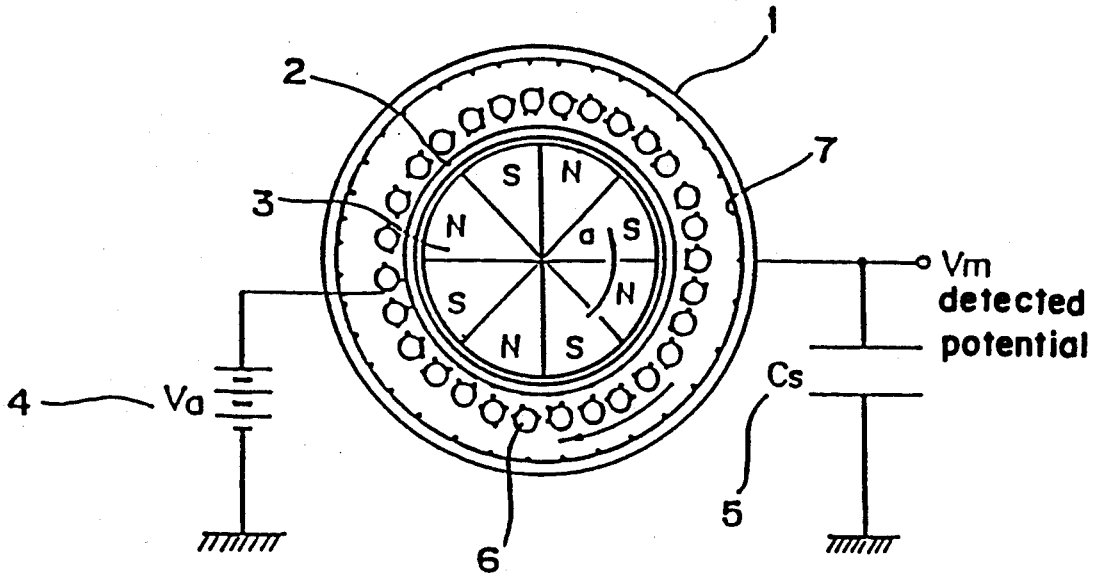
FIG. 3 illustrates the schematic construction of the apparatus for measuring the charge distribution.
Figure 4:
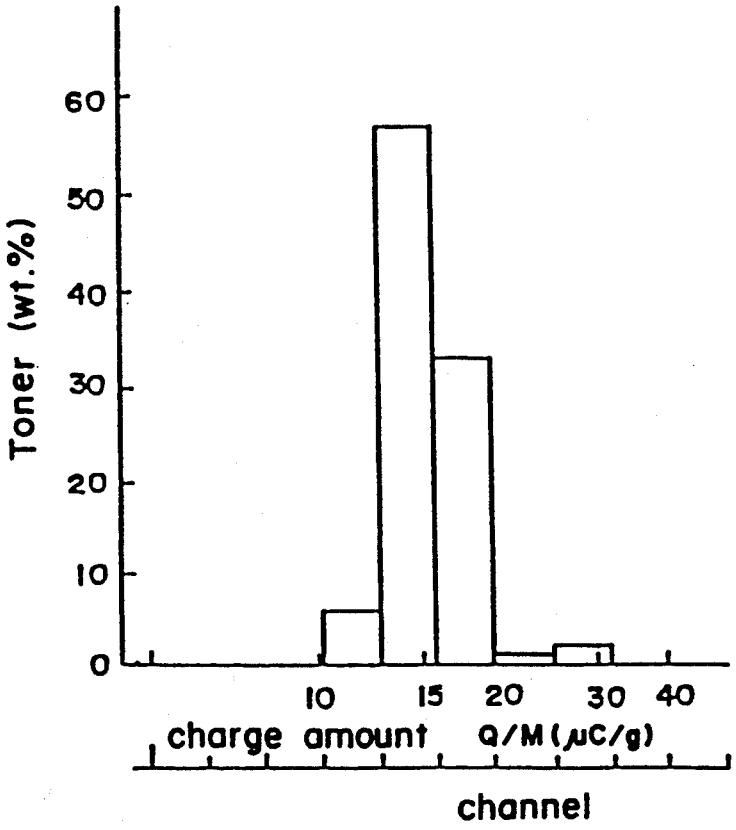
FIG. 4 is a graph for showing the results of the measurement of the charge distribution.

In this connection, the numerals in the drawings designate as follows:

1 . . . a cylindrical electrode, 2 . . . a electrically conductive sleeve,

3 . . . a magnet roll, 4 . . . a bias supply,

5 . . . a standard condenser, 6 . . . a developer,

7 . . . separated toner.

We claim;

1. A color toner other than black for developing an electrostatic latent image, which comprises a non-magnetic core particle and fine particles of a charge-enhancing agent fixed on the surface of the core particle by fusing the surface of the core particle at the content of 0.03 to 0.65% by weight on the basis of the toner weight, said non-magnetic core particle containing a thermoplastic resin and a colorant other than black.

2. A color toner other than black for developing an electrostatic latent image, which comprises a non-magnetic core particle and fine particles of a charge-enhancing agent fixed on the surface of the core particle by fusing the surface of the core particle at the content of 0.005 to 0.65% by weight on the basis of the toner weight, said non-magnetic core particle containing a thermoplastic resin, a resin composed of at least a nitrogen containing polar functional group or a fluorine containing polar functional group and a colorant other than black.

3. A color toner of claim 1, wherein said fine particles of a charge-enhancing agent are fixed by heating the surface of the core particle.

4. A color toner of claim 1, wherein the particle diameter of the core particle is within a range of 4 to 20 μm.

5. A color toner of claim 1, wherein said fine particles of a charge-enhancing agent fixed on the surface of the core particles are effective primary particles.

6. A color toner other than black for developing an electrostatic latent image, which comprises a non-magnetic core particle, a colorant layer other than black formed on the core particle, a fine resinous particle layer formed on the colorant layer, and fine particles of a charge-enhancing agent fixed on the surface of the fine resinous particle layer by fusing the surface of the core particle at the content of 0.03 to 0.65% by weight on the basis of the toner weight, said non-magnetic core particle containing a thermoplastic resin.

7. A color toner of claim 1, wherein said fine particles of a charge-enhancing agent are fixed on the surface of the core particle by a pressure of agitating.

8. A color toner of claim 1, wherein said fine particles of a charge-enhancing agent are fixed on the surface of the core particle by dispersing into a heated air current.

9. A color toner of claim 1, wherein said fine particles of a charge-enhancing agent are fixed on the surface of the core particle by organic solvent.

10. A color toner other than black for developing an electrostatic latent image, which is obtained by the steps of:

pulverizing a resinous material comprising a binder resin and a colorant other than black using means for pulverizing to prepare a resinous particle;

classifying the resinous particle using means for classifying to obtain a core particle having a predetermined particle size;

mixing the core particle with a charge-enhancing agent, thereby to attach the charge-enhancing agent to the surface of the core particle; and fixing the charge-enhancing agent to the surface of the core particle by fusing the surface of the core particle.

11. A color toner of claim 10, wherein the particle diameter of said core particle is within a range of from 4 to 20 μm.

12. A color toner of claim 10, wherein the charge-enhancing agent fixed to the surface of the core is a primary particle.

13. A color toner of claim 10, wherein the content of the charge-enhancing agent is from 0.03 to 0.65% by weight on the basis of the toner weight.

14. A color toner of claim 10, wherein the core particle contains a resin which comprises a nitrogen containing polar functional group or a fluorine containing polar functional group.

15. A color toner of claim 14, wherein the content of the charge-enhancing agent is from 0.005 to 0.065% by weight on the basis of the toner weight.

16. A color toner of claim 10, wherein the charge-enhancing agent is fixed on the surface of the core particle by a pressure of agitating.

17. A color toner of claim 10, wherein the charge-enhancing agent is fixed on the surface of the core particle by dispersing into a heated air current.

18. A color toner of claim 10, wherein the charge-enhancing agent is fixed on the surface of the core particle by organic solvent.

19. A color toner other than black for developing an electrostatic latent image, which is obtained by the steps of:

preparing a core particle of a thermoplastic resin by polymerizing at least one of monofunctional monomers and polyfunctional monomers;

mixing the core particle with a charge-enhancing agent, thereby to attach the charge-enhancing agent to the surface of the core particle; and fixing the charge-enhancing agent to the surface of the core particle by fusing the surface of the core particle.

* * * * *